US008461944B2

(12) United States Patent
Ligander et al.

(10) Patent No.: US 8,461,944 B2
(45) Date of Patent: Jun. 11, 2013

(54) FIRST AND SECOND U-SHAPE WAVEGUIDES JOINED TO A DIELECTRIC CARRIER BY A U-SHAPE SEALING FRAME

(75) Inventors: Per Ligander, Göteborg (SE); Marcus Karl Hasseblad, Mölndal (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 374 days.

(21) Appl. No.: 12/810,051

(22) PCT Filed: Dec. 20, 2007

(86) PCT No.: PCT/SE2007/001152

§ 371 (c)(1),
(2), (4) Date: Jun. 22, 2010

(87) PCT Pub. No.: WO2009/082282

PCT Pub. Date: Jul. 2, 2009

(65) Prior Publication Data

US 2010/0321136 A1 Dec. 23, 2010

(51) Int. Cl.
*H01P 1/04* (2006.01)

(52) U.S. Cl.
USPC ..... 333/254

(58) Field of Classification Search
USPC ..... 333/248, 254, 239, 208, 212, 24 R, 333/26, 27, 137, 157
See application file for complete search history.

(56) References Cited

U.S. PATENT DOCUMENTS

| | | | | |
|---|---|---|---|---|
| 3,390,901 | A | 7/1968 | Bibb | |
| 4,020,875 | A | 5/1977 | Akiba | |
| 4,517,536 | A * | 5/1985 | Stern et al. | 333/254 |
| 5,380,386 | A | 1/1995 | Oldham et al. | |
| 6,768,401 | B2 * | 7/2004 | Koriyama | 333/248 |
| 7,323,954 | B2 * | 1/2008 | Lee et al. | 333/202 |
| 2004/0183627 | A1 * | 9/2004 | Lo Hine Tong et al. | 333/212 |

FOREIGN PATENT DOCUMENTS

| | | | |
|---|---|---|---|
| FR | 2660803 | A1 | 10/1991 |
| JP | 63013501 | A | 1/1988 |
| JP | 2001 053509 | A | 2/2001 |

OTHER PUBLICATIONS

Muller, T. et al. Surface-Mountable Metalized Plastic Waveguide Filter Suitable for High Volume Production. 33rd European Microwave Conference, Munich 2003.

* cited by examiner

*Primary Examiner* — Benny Lee
(74) *Attorney, Agent, or Firm* — Roger S. Burleigh

(57) ABSTRACT

The present invention relates to a transition arrangement comprising a first surface-mountable waveguide part and a second surface-mountable waveguide part, each of the first and second surface-mountable waveguide parts comprising a first wall, a second wall and a third wall, which second and third walls are arranged to contact a dielectric carrier material, all the walls together essentially forming a U-shape, where the first and second surface-mountable waveguide parts are arranged to be mounted on the dielectric carrier material in such a way that the first and second surface-mountable waveguide parts comprise ends which are positioned to face each other. The transition arrangement further comprises an electrically conducting sealing frame that is arranged to be mounted over and covering the ends, where the electrically conducting frame has a first wall, a second wall and a third wall, where the second and third walls are arranged to contact the dielectric carrier material, all the walls together essentially forming a U-shape.

13 Claims, 4 Drawing Sheets

Section A-A

FIRST AND SECOND U-SHAPE WAVEGUIDES JOINED TO A DIELECTRIC CARRIER BY A U-SHAPE SEALING FRAME

TECHNICAL FIELD

The present invention relates to a transition arrangement comprising a first surface-mountable waveguide part and a second surface-mountable waveguide part, the first surface-mountable waveguide part comprising a first wall, a second wall and a third wall, which second and third walls are arranged to contact a dielectric carrier material, all the walls together essentially forming a U-shape, the second surface-mountable waveguide part comprising a first wall, a second wall, and a third wall, which second and third walls are arranged to contact the dielectric carrier material, all the walls together essentially forming a U-shape, where the first and second surface-mountable waveguide parts are arranged to be mounted on the dielectric carrier material in such a way that the first and second surface-mountable waveguide parts comprise ends which are positioned to face each other.

The present invention also relates to an electrically conducting sealing frame.

BACKGROUND

When designing microwave circuits, transmission lines and waveguides are commonly used. A transmission line is normally formed on a dielectric carrier material. Due to losses in the dielectric carrier material, it is sometimes not possible to use any transmission lines. When there for example is a diplexer in the layout, the diplexer may have to be realized in waveguide technology. Waveguides are normally filled with air or other low-loss materials.

Waveguide diplexers used today are large mechanical components screwed into a mechanical cabinet and connected to different parts such as for example an antenna via some type of waveguide flange. It is desirable to mount such a diplexer structure on a dielectric carrier material, such that the diplexer structure forms a surface-mounted waveguide structure.

Such a surface-mounted waveguide is normally made having three walls and one open side. Metalization is then provided on the side of the dielectric carrier material facing the waveguide, where the metalization serves as the remaining wall of the waveguide, thus closing the waveguide structure when the waveguide is fitted to the dielectric carrier material.

An example of surface-mountable waveguides is disclosed in the paper "Surface-mountable metalized plastic waveguide filter suitable for high volume production" by Thomas J Müller, Wilfried Grabherr, and Bemd Adelseck, 33$^{rd}$ European Microwave Conference, Munich 2003. Here, a surface-mountable waveguide is arranged to be mounted on a so-called footprint on a circuit board. A microstrip conductor to waveguide transition is disclosed, where the end of the microstrip conductor acts as a probe for feeding the waveguide's opening.

Surface mounting of large mechanical components, such as diplexers, may result in mechanical stress problems due to different coefficients of thermal expansion of the materials involved, such as for example so-called twist and bow. Furthermore, such a large surface-mounted structure as a diplexer is too large to handle in an automated production line.

One way to solve this problem is to split the diplexer into a number of smaller parts. These parts have to be sufficiently connected to each other in order to present a proper electrical function. This problem is apparent for all large surface-mounted waveguide structures.

An example of a solution according to prior art is disclosed in prior art FIG. 1, showing a simplified cross-sectional side-view. A first surface-mounted waveguide part P1 and a second surface-mounted waveguide part P2 are mounted on a dielectric carrier material P3. The ends of the first and second surface-mounted waveguide parts P1, P2 that face each other comprise respective 90° bends P4, P5, changing the direction of the transmitted signals 90° such that the signals are directed through corresponding openings P6, P7 in the dielectric carrier material P3. On the other side of the dielectric carrier material P3, a third surface-mounted waveguide part P8 is mounted, the third surface-mounted waveguide part P8 comprising two 90° bends P9, P10 positioned such that the signal directed through the openings P6, P7 is guided through the third surface-mounted waveguide part P8 in such a way that the third surface-mounted waveguide part P8 functions as a link between the first surface-mounted waveguide part P1 and the second surface-mounted waveguide part P2. The details of the bends P4, P5, P9, P10 are not shown in FIG. 1, only the function is schematically indicated.

This solution is, however, rather complicated and requires that a special waveguide part, having two 90° bends, is mounted on the other side of the dielectric carrier, material, and that all waveguide parts are aligned with the openings such that there is no interruption in the transmission of the signals.

SUMMARY OF THE INVENTION

The object of the present invention is to provide a waveguide transition arrangement between different surface-mounted waveguide structure parts which are to be sufficiently electrically connected to each other in order to present a proper electrical function.

This problem is solved by means of a waveguide arrangement as mentioned initially. The arrangement further comprises an electrically conducting sealing frame also referred to as a "sealing frame") that is arranged to be mounted over and covering the ends where the sealing frame has a first wall, a second wall and a third wall, where the second and third walls are arranged to contact the dielectric carrier material, all the walls together essentially forming a U-shape.

This problem is also solved by means of an electrically conducting sealing frame according to the above.

According to a preferred embodiment, there is a junction gap between the ends, where the sealing frame is arranged to seal the junction gap, such that transition properties for a signal that is transferred between the surface-mounted waveguide parts (also referred to as "waveguide parts") are enhanced. In other words, the properties of the signal are enhanced as the signal transitions between the surface-mounted waveguide parts due to the sealing frame.

According to another preferred embodiment, the waveguide parts each have a respective longitudinally extending flange part comprised in each of the second walls and third walls, and that the sealing frame has a respective longitudinally extending flange part, each having a length, the flange parts being comprised in each of the second and third walls, all the flange parts being arranged to be the parts of the walls which contact the dielectric carrier material when the waveguide parts and the sealing frame are mounted thereto.

According to another preferred embodiment, the flange parts of the waveguide parts do not extend to the ends of the waveguide parts, such that a first distance between the ends of opposing flange parts of the second walls of the waveguide parts and a second distance between the ends of opposing flange parts of the third walls of the waveguide parts both exceed the length of each one of the flange parts of the sealing frame, such that the flange parts of the sealing frame may be fitted between the respective flange parts of the waveguide parts.

According to another preferred embodiment, the sealing frame is made in several layers of material including an outer layer being made of an electrically insulating material, a middle layer constituting a metalization layer, thereby making the sealing frame electrically conductive, and an inner layer comprising an electrically conducting attachment means in the form of a solder alloy or electrically conducting glue.

According to another preferred embodiment, in a part of the first surface-mountable waveguide part (also referred to as the "first waveguide part") which is arranged to be covered by the sealing frame, a first recess is formed, running perpendicular to the longitudinal extension of the first waveguide part, all the way along the three walls, where a corresponding second recess is formed on the second surface-mountable waveguide part (also referred to as the "second waveguide part"), and where, corresponding to the recesses, lines of an electrically conducting attachment means are dispensed on the sides of the walls of the sealing frame that are intended to face the first and second waveguide parts, such that the lines of electrically conducting attachment means are fitted into the recesses when the sealing frame is mounted.

Other preferred embodiments are evident from the disclosure as set forth below.

A number of advantages are provided by the present invention. For example:

- the sealing arrangement is simple and of low cost;
- a connection of two surface-mounted waveguide parts is achieved without disturbance of the waveguide mode of a propagating signal;
- two surface-mounted waveguide parts are connected in a loss-less manner;
- two surface-mounted waveguide parts are connected in a flexible manner, providing a relaxed relation between the waveguide parts due to the ductile behavior of the sealing frame;
- two surface-mounted waveguide parts are connected without any risk of leakage;
- the present invention can be assembled using a pick-and-place machine; and
- two surface-mounted waveguide parts are connected using no extra area on the dielectric material on which the surface-mounted waveguide parts are mounted;

BRIEF DESCRIPTION OF THE DRAWINGS

The present invention will now be described more in detail with reference to the appended drawings, where.

DETAILED DESCRIPTION OF THE INVENTION

Figure 1:
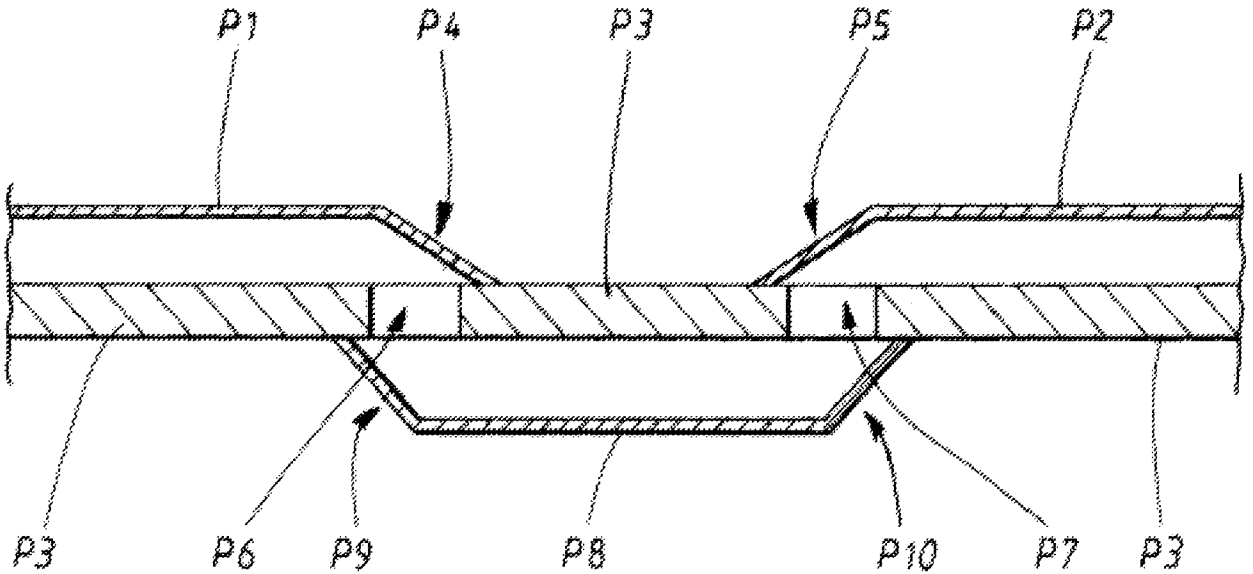
FIG. 1 PRIOR ART
FIG. 1 is a sectional side-view of a prior art configuration.
Figure 2A:
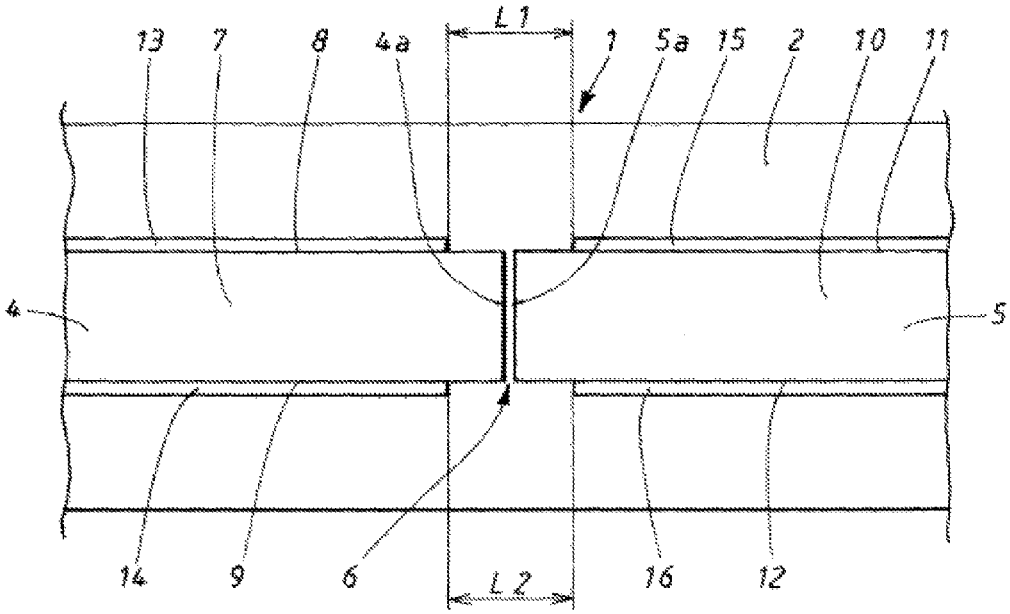
FIG. 2*a* is a top view of two surface-mounted waveguide parts.
Figure 2B:
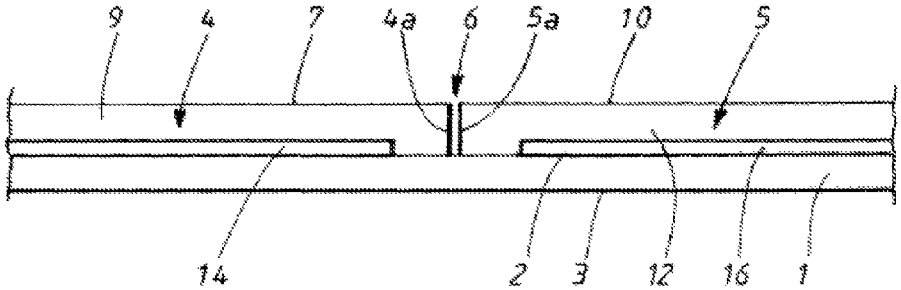
FIG. 2*b* is a side view of two surface-mounted waveguide parts.

In FIG. 2*a* and FIG. 2*b*, showing a respective top view and side view of a first embodiment example of the present invention, a dielectric carrier material 1 is shown, having a first main side 2 and a second main side 3 (see FIG. 2*b*), originally having a metallic cladding on both sides. The metallic cladding is typically comprised of a layer of copper, which optionally is covered with thin layers of other metals to enhance the electrical, mechanical, and chemical properties of the cladding. The metal on the second main side 3 is used as a ground plane, and the metal on the first main side 2 is etched away to such an extent that desired metal patterns are formed on the first main side 2. A first surface-mountable waveguide part (also referred to as a "first waveguide part") 4 and a second surface-mountable waveguide part (also referred to as a "second waveguide part") 5 are mounted on the dielectric carrier material 1. The respective ends 4*a*, 5*a* of the first and second surface-mounted waveguide parts 4, 5 that face each other are positioned relatively close to each other, preferably as close as possible, minimizing a junction gap 6 between the first and second waveguide parts 4, 5.

With continuing reference to FIGS. 2*a* and 2*b*, each of the first and second waveguide parts 4, 5 has three walls 7, 8 (see FIG. 2*a*), 9 for the first waveguide part 4 and three walls 10, 11 (see FIG. 2*a*), 12 for the second waveguide part 5 and one open side, arranged to face the dielectric carrier material 1. Metalization is provided on the side of the dielectric carrier material 1 facing the first and second waveguide parts 4, 5, where the metalization serves as the remaining wall of the first and second waveguide parts 4, 5, thus closing the first and second waveguide parts 4, 5 when mounted onto the dielectric carrier material 1 (see FIGS. 2*a* and 2*b*).

Figure 2C:
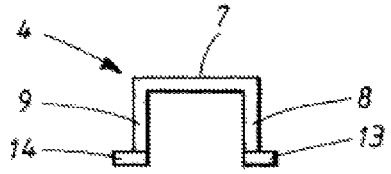
FIG. 2*c* is an end view of a surface-mountable waveguide part.

Regarding the first waveguide part 4, with reference to FIGS. 2*a*, 2*b* and 2*c*, a first wall 7 is arranged to be parallel to the dielectric carrier material 1 when the first waveguide part 4 is mounted, and then held at a distance from the dielectric carrier material 1 by means of a second wall 8 and third wall 9, which second and third walls 8, 9 are arranged to contact the dielectric carrier material 1, all the walls 7, 8, 9 together essentially forming a U-shape when regarding the first waveguide part 4 from a short end thereof. The second waveguide part 5 has the same configuration of the walls 10, 11, 12.

The first and second waveguide parts 4, 5 are mounted in a known way, each having a longitudinally extending flange part (also referred to as a "flange") 13 (see FIGS. 2*a* and 2*c*), 14, 15 (see FIG. 2*a*), 16 comprised in each of the second walls 8, 11 and third walls 9, 12, the flanges 13, 14, 15, 16 being arranged to be the parts of the walls 8, 11, 9, 12 which contact the dielectric carrier material 1 when the first and second waveguide parts 4, 5 are mounted thereto. The flanges 13, 14, 15, 16 are soldered, or glued by means of electrically conducting glue, to a corresponding so-called footprint of metal on the first main side 2 of the dielectric carrier material 1.

As indicated above, there is, however, always a junction gap 6 between the first and second waveguide parts 4, 5. At the junction gap 6, the currents running between the first and second waveguide parts 4, 5 experience a discontinuity, and there is possibly also undesired leakage at the junction gap 6. It should be noted that like features with the same reference numbers in different Figures often will not be described again in the interest of brevity.

Figure 3A:
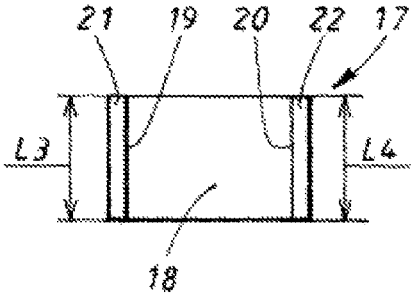
FIG. 3*a* is a top view of a sealing frame according to the present invention.
Figure 3B:
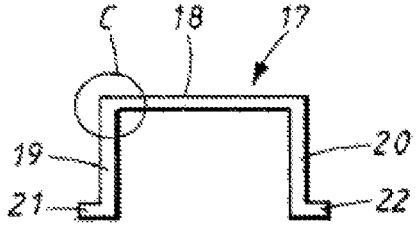
FIG. 3*b* is an end view of a sealing frame according to the present invention.
Figure 4A:
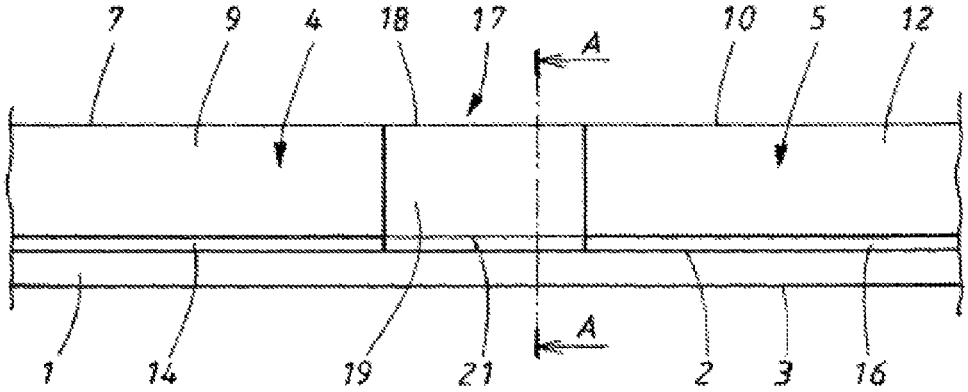
FIG. 4*a* is a side view of a sealing frame according to the present invention being mounted to two surface-mounted waveguide parts.

According to the present invention, with reference to FIG. 3*a*, FIG. 3*b* and FIG. 4*a*, an electrically conducting sealing frame (also referred to as a "sealing frame") 17 is arranged to be mounted over the junction gap 6 (see also FIGS. 2*a* and 2*b*). The sealing frame 17 has a first wall 18, a second wall 19 and a third wall 20 (see FIGS. 3*a* and 3*b*), where the first wall 18 is arranged to be parallel to the dielectric carrier material 1 (see FIG. 4*a*) when mounted, and then held at a distance from the dielectric carrier material 1 by means of the second wall 19 and the third wall 20, where the second and third walls 19, 20 are arranged to contact the dielectric carrier material 1, all the walls 18, 19, 20 together essentially forming a U-shape when regarding the sealing frame 17 from a short end thereof.

With continuing reference to FIGS. 3*a* and 3*b*, the sealing frame 17 has a respective longitudinally extending flange part (also referred to as a "flange(s)") 21, 22 comprised in each of the second wall 19 and third wall 20, each having a length L3, L4 (see FIG. 3*a*), the flanges 21, 22 being arranged to be the parts of the walls 19, 20 which contact the dielectric carrier material 1 when the sealing frame 17 is mounted. The lengths L3, L4 of the flanges 21, 22 are preferably essentially equal.

The sealing frame 17 has such dimensions to fit the sealing frame 17 over the first and second waveguide parts, i.e. the inner dimensions of the sealing frame 17 are equal to, or greater than, the outer dimensions of the first and second waveguide parts 4, 5 (see FIG. 4*a*). The thickness of the sealing frame 17 is not of importance. However, the sealing frame 17 should preferably be rigid enough to be handled, for example by a human or by a pick-and place machine.

As can be seen in FIG. 2*a* and FIG. 2*b*, the flanges 13, 14, 15, 16 of the first and second waveguide parts 4, 5 do not extend to the ends 4*a*, 5*a* of the first and second waveguide parts 4, 5 that face each other, such that a first distance L1 (see FIG. 2*a*) between the ends of opposing flanges 13, 15 of the second walls 8, 11 of the first and second waveguide parts 4, 5 and a second distance L2 (see FIG. 2*a*) between the ends of opposing flanges 14, 16 of the third walls 9, 12 of the first and second waveguide parts 4, 5 both exceed the lengths L3, L4 of each one of the flanges 21, 22 of the sealing frame 17 (see FIG. 3*a*), such that the flanges 21, 22 of the sealing frame 17 (see FIG. 3*b*) may be fitted between the respective flanges 14, 16, 13, 15 of the first and second waveguide parts 4, 5. Preferably, the distances L1 and L2 between the ends of opposing flanges 14, 16, 13, 15 of the first and second waveguide parts 4, 5 are positioned essentially opposite each other with reference to the longitudinal extension of the first and second waveguide parts 4, 5.

Figure 4B:
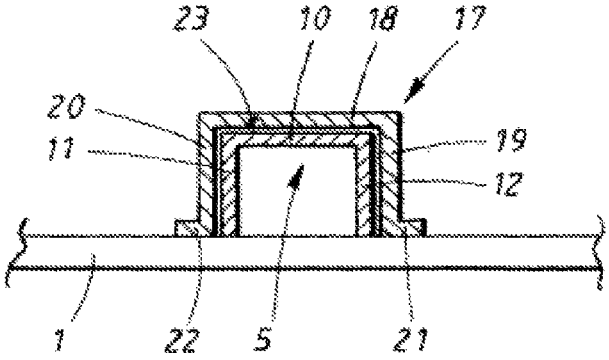
FIG. 4*b* is a sectional view of a section A-A in FIG. 4*a;*

With reference to FIG. 4*a* and FIG. 4*b*, when mounted, the sealing frame 17 is fitted over the junction gap 6 (see FIGS. 2*a* and 2*b*) between the first and second waveguide parts 4 (see FIG. 4*a*), 5, thereby sealing the junction gap 6. The sealing frame 17 is then soldered to the first and second waveguide parts 4, 5. The solder or glue is indicated with the reference number 23 (see FIG. 4*b*).

Figure 5:
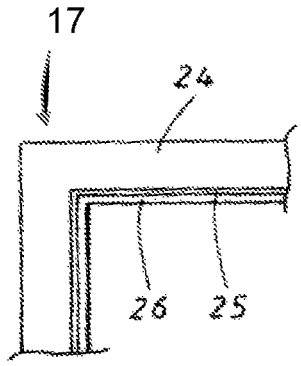
FIG. 5 is a detailed view of a part of the sealing frame, illustrating a preferred embodiment.

According to a preferred embodiment, with reference to FIG. 5, showing the part of the sealing frame 17 indicated by a circle C in FIG. 3*b*, the sealing frame 17 is made in several layers of material. The outer layer 24 is made of a ductile layer, having electrically insulating properties, for example a polymer or a ceramic material such as a Low Temperature Co-fired Ceramic ("LTCC"). Inside the outer layer 24 there is a metalization layer 25, making the sealing frame 17 electrically conductive. The metalization layer 25 is in turn covered by a soft solder alloy 26 with an appropriate thickness, for example about 150 micrometers ("μm"). The soft solder alloy 26 may be exchanged with any appropriate electrically conducting attachment means, such as electrically conducting glue. It is also conceivable to use any other type of solder alloy depending on the properties of the materials actually used.

Figure 6:
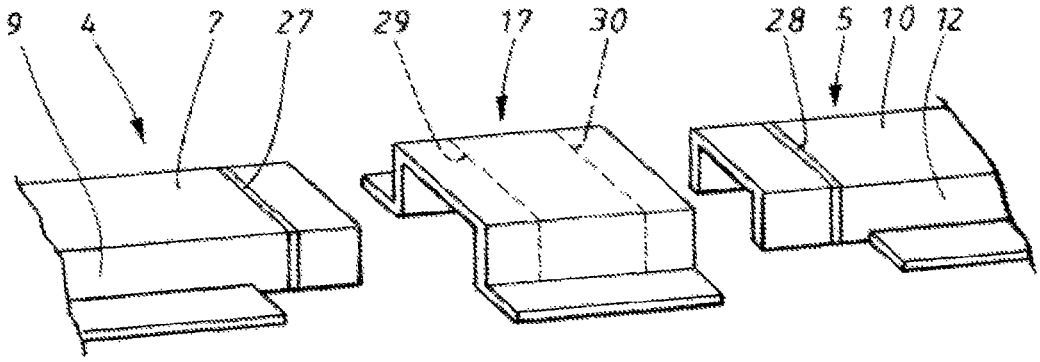
FIG. 6 is an exploded perspective view of two surface-mountable waveguide parts and a sealing frame according to the present invention.

According to another preferred embodiment, with reference to FIG. 6 showing an exploded perspective view of the first waveguide part 4, the second waveguide part 5 and the sealing frame 17 positioned slightly apart from each other due to the exploded view, at the part of the first waveguide part 4 which is arranged to be covered by the sealing frame 17, a first recess 27 is formed. The first recess 27 runs perpendicular to the longitudinal extension of the first waveguide part 4, all the way along the three walls 7, 8, 9. (See FIG. 2*b* for the second wall 8 of the first waveguide part 4.) A corresponding second recess 28 is formed on the second waveguide part 5.

Corresponding to the recesses 27, 28, lines of solder compound 29, 30 are dispensed on the sides of the walls 18, 19, 20 of the sealing frame 17 (see also FIGS. 3*a* and 3*b*) that are intended to face the first and second waveguide parts 4, 5, such that the lines of solder 29, 30 are fitted into the recesses 27, 28 when the sealing frame 17 is mounted. It is possible to combine the lines of solder 29, 30 with indents in the sealing frame 17, the indents being intended to fit into the recesses 27, 28 when the sealing frame 17 is mounted. The solder may be exchanged with any appropriate electrically conducting attachment means, such as electrically conducting glue.

The present invention is not limited to the embodiment examples according to the above, but may vary freely within the scope of the appended claims.

For example, the metal used may be any suitable conducting material, for example copper, silver, or gold. The metallic claddings may be deposited onto the dielectric carrier material by various methods, for example printing, plating, or rolling.

The dielectric carrier material may comprise several layers if necessary, the layers comprising different types of circuitry. Such a layered structure may also be necessary for mechanical reasons.

The flanges may be of any suitable form, generally forming flange parts.

The invention claimed is:

1. A transition arrangement comprising:

a first waveguide part; and a second waveguide part;

the first waveguide part comprising a first wall, a second wall, and a third wall, the second and third walls are arranged to contact a dielectric carrier material, the first, second and third walls together essentially forming a U-shape;

the second waveguide part comprising a first wall, a second wall and a third wall, the second and third walls are arranged to contact the dielectric carrier material, the first, second and third walls together essentially forming a U-shape;

the first and second waveguide parts are arranged to be mounted on the dielectric carrier material in such a way that the first and second waveguide parts comprise respective ends that are positioned to face each other; and an electrically conducting sealing frame that is arranged to be mounted over and covering the ends where the electrically conducting sealing frame has a first wall, a second wall and a third wall, where the second and third walls are arranged to contact the dielectric carrier material, the first wall of the electrically conducting sealing frame being substantially parallel to the dielectric carrier material and essentially forming a U-shape with the second and third walls of the electrically conducting sealing frame.

2. The transition arrangement according to claim 1, further comprising a junction gap between the ends, where the electrically conducting sealing frame is arranged to seal the junction gap, such as to enhance a signal that is transferred between the first and second waveguide parts.

3. The transition arrangement according to claim 1, wherein the first and second waveguide parts each have a respective longitudinally extending flange part comprised in each of the second walls and third walls thereof, and the electrically conducting sealing frame has a respective longitudinally extending flange part, being comprised in each of the second wall and the third wall of the electrically conductive sealing frame, each flange part being arranged to be parts of the respective second and third walls that contact the dielectric carrier material when the first and second waveguide parts and the electrically conducting sealing frame are mounted.

4. The transition arrangement according to claim 3, wherein the flange parts of the first and second waveguide parts do not extend to the ends of the first and second waveguide parts, such that a first distance between the ends of opposing flange parts of the second walls of the first and second waveguide parts and a second distance between the ends of opposing flange parts of the third walls of the first and second waveguide parts both exceed a length of each one of the flange parts of the electrically conducting sealing frame, such that the flange parts of the electrically conducting sealing frame may be fitted between the respective flange parts of the first and second waveguide parts.

5. The transition arrangement according to claim 4, wherein the first distance and the second distance are essentially equal, and that the lengths of the flange parts of the electrically conducting sealing frame are essentially equal.

6. The transition arrangement according to claim 1, wherein the electrically conducting sealing frame is attached to the first and second waveguide parts by means of solder or electrically conducting glue.

7. The transition arrangement according to claim 1, wherein the electrically conducting sealing frame is made in several layers of material including an outer layer being made of an electrically insulating material, a middle layer constituting a metalization layer, thereby making the electrically conducting sealing frame electrically conductive, and an inner layer comprising an electrically conducting attachment means a the form of a solder alloy or electrically conducting glue.

8. The transition arrangement according to claim 1, wherein a first recess is formed in a part of the first waveguide part that is arranged to be covered by the electrically conducting sealing frame, the first recess running perpendicular to a longitudinal extension of the first waveguide part, along the first, second and third walls thereof, where a corresponding second recess is formed on the second waveguide part, and where, corresponding to the first and second recesses, lines of an electrically conducting attachment means are dispensed on sides of the first, second and third walls of the electrically conducting sealing frame that are intended to face the first and second waveguide parts, such that the lines of the electrically conducting attachment means are fitted into the first and second recesses when the electrically conducting sealing frame is mounted.

9. The transition arrangement according to claim 8, wherein the lines of the electrically conducting attachment means are combined with indents in the electrically conducting sealing frame, the indents being intended to fit into the first and second recesses when the electrically conducting sealing frame is mounted.

10. The transition arrangement according to claim 8, wherein the lines of the electrically conducting attachment means is in the form of solder or electrically conducting glue.

11. An electrically conducting sealing frame arranged to be mounted over and cover respective ends of a first waveguide part and a second waveguide part, the electrically conducting sealing frame comprising:

a first wall;

a second wall;

a third wall, where the second and third walls are arranged to contact a dielectric carrier material, the first, second and third walls together essentially forming a U-shape;

wherein the first waveguide part comprises a first wall, a second wall and a third wall, the second and third walls are arranged to contact the dielectric carrier material, the first, second and third walls together essentially forming a U-shape;

wherein the second waveguide part comprises a first wall, a second wall and a third wall, the second and third walls are arranged to contact the dielectric carrier material, the first, second and third walls together essentially forming a U-shape; and wherein the first and second waveguide parts are arranged to be mounted on the dielectric carrier material in such a way that the first and second waveguide parts comprise the respective ends that are positioned to face each other.

12. The electrically conducting sealing frame according to claim 11, wherein the electrically conducting sealing frame is attached to the first and second waveguide parts by means of solder or electrically conducting glue.

13. The electrically conducting sealing frame according to claim 11, wherein the electrically conducting sealing frame is made in several layers of material including an outer layer being made of an electrically insulating material, a middle layer constituting a metalization layer, thereby making the electrically conducting sealing frame electrically conductive, and an inner layer comprising an electrically conducting attachment means in a form of a solder alloy or electrically conducting glue.

* * * * *

UNITED STATES PATENT AND TRADEMARK OFFICE

CERTIFICATE OF CORRECTION

PATENT NO. : 8,461,944 B2
APPLICATION NO. : 12/810051
DATED : June 11, 2013
INVENTOR(S) : Ligander et al.

It is certified that error appears in the above-identified patent and that said Letters Patent is hereby corrected as shown below:

On the Title Page, in Item (75), under "Inventors", in Column 1, Line 2, delete "Hasseblad," and insert -- Hasselblad, --, therefor.

In the Specification

In Column 1, Line 51, delete "Bemd" and insert -- Bernd --, therefor.

In Column 2, Line 25, delete "carrier," and insert -- carrier --, therefor.

In Column 3, Line 51, delete "mounted;" and insert -- mounted. --, therefor.

In the Claims

In Column 7, Line 51, in Claim 7, delete "a the" and insert -- in a --, therefor.

Signed and Sealed this
Eleventh Day of February, 2014

Michelle K. Lee

Michelle K. Lee
*Deputy Director of the United States Patent and Trademark Office*